US008795006B2

(12) United States Patent
Hoffman

(10) Patent No.: US 8,795,006 B2
(45) Date of Patent: Aug. 5, 2014

(54) RECONFIGURABLE ELECTRICAL TERMINAL WITH MULTIPLE CONFIGURATIONS EMPLOYING A CLAMP AND A FASTENER

(71) Applicant: Leviton Manufacturing Co., Inc., Melville, NY (US)

(72) Inventor: Jerry R. Hoffman, Hickory, NC (US)

(73) Assignee: Leviton Manufacturing Co., Inc., Melville, NY (US)

( * ) Notice: Subject to any disclaimer, the term of this patent is extended or adjusted under 35 U.S.C. 154(b) by 55 days.

(21) Appl. No.: 13/652,571

(22) Filed: Oct. 16, 2012

(65) Prior Publication Data

US 2014/0106627 A1 Apr. 17, 2014

(51) Int. Cl.

| | |
|---|---|
| ***H01R 4/36*** | (2006.01) |
| ***H01R 4/48*** | (2006.01) |
| ***H01R 43/26*** | (2006.01) |

(52) U.S. Cl.
CPC . *H01R 4/48* (2013.01); *H01R 43/26* (2013.01)
USPC ..... 439/811

(58) Field of Classification Search
USPC ..... 439/863, 803, 806, 811, 877
See application file for complete search history.

(56) References Cited

U.S. PATENT DOCUMENTS

| | | | | |
|---|---|---|---|---|
| 2,953,771 | A * | 9/1960 | Kussy | 439/791 |
| 4,090,769 | A | 5/1978 | Damsky | |
| 4,552,421 | A | 11/1985 | Drapkin | |
| 5,358,429 | A | 10/1994 | Mina | |
| 5,396,062 | A | 3/1995 | Eisentraut et al. | |
| 5,427,550 | A | 6/1995 | Jaag | |
| 5,472,350 | A | 12/1995 | Mehta | |
| 5,476,397 | A | 12/1995 | Leff et al. | |
| 5,486,650 | A | 1/1996 | Yetter | |
| 5,553,787 | A * | 9/1996 | Guginsky | 439/472 |
| 5,594,205 | A | 1/1997 | Cancellieri et al. | |
| 5,651,696 | A | 7/1997 | Jennison | |
| 5,661,623 | A | 8/1997 | McDonald et al. | |
| 5,712,450 | A | 1/1998 | Chan et al. | |
| 5,753,858 | A | 5/1998 | Eder et al. | |
| 5,856,633 | A | 1/1999 | Zelkovsky | |
| 5,921,799 | A | 7/1999 | Forrester | |
| 5,989,067 | A | 11/1999 | Morgan et al. | |

(Continued)

FOREIGN PATENT DOCUMENTS

| | | | |
|---|---|---|---|
| GB | 2345389 | B1 | 8/2002 |
| JP | 1997-9097659 | A1 | 4/1997 |
| JP | 2006228707 | A1 | 8/2006 |
| WO | 2011064639 | A2 | 6/2011 |

*Primary Examiner* — Chandrika Prasad
(74) *Attorney, Agent, or Firm* — Leviton Manufacturing Co., Inc.

(57) ABSTRACT

An electrical receptacle terminal includes a contact portion having a plurality of tabs, a clamp having a notch on one end and an aperture on a second end, and a fastener that engages the clamp aperture. The notch on the clamp is configured to receive any one of the plurality of tabs on the contact portion, so that the contact portion is substantially perpendicular to the clamp. The configuration of the terminal varies depending on which one of the plurality of tabs of the contact portion is engaged with the notch on the clamp. The positioning of the clamp in relation to the contact portion, and the ability to configure a terminal in a different orientation with the same component parts, allows for substantially identical terminal components to be used in one or more receptacle terminals as well as substantially identical terminal components across different types of receptacles.

29 Claims, 10 Drawing Sheets

(56) References Cited

U.S. PATENT DOCUMENTS

| | | | | |
|---|---|---|---|---|
| 5,998,734 | A | 12/1999 | Kerestan et al. | |
| 6,010,347 | A * | 1/2000 | Lee | 439/222 |
| 6,027,310 | A | 2/2000 | Kerr et al. | |
| 6,095,874 | A | 8/2000 | Quaranta | |
| 6,188,020 | B1 | 2/2001 | Osterbrock et al. | |
| 6,281,438 | B1 | 8/2001 | Desilets et al. | |
| 6,325,654 | B1 | 12/2001 | Kerr et al. | |
| 6,464,524 | B1 | 10/2002 | Kerr et al. | |
| 6,676,376 | B2 | 1/2004 | Kerr | |
| 6,676,442 | B2 | 1/2004 | Kerr | |
| 6,792,953 | B2 | 9/2004 | Lesser et al. | |
| 6,945,815 | B1 | 9/2005 | Mullally | |
| 6,997,740 | B2 | 2/2006 | Kerr | |
| 7,160,148 | B2 | 1/2007 | Kerr | |
| 7,252,534 | B2 * | 8/2007 | Reibke | 439/404 |
| 7,270,581 | B2 | 9/2007 | Tiberio | |
| 7,354,296 | B1 * | 4/2008 | Katwala et al. | 439/441 |
| 7,432,442 | B2 | 10/2008 | Peck | |
| 7,470,143 | B2 * | 12/2008 | Osborn et al. | 439/441 |
| 7,575,486 | B2 * | 8/2009 | Weber et al. | 439/811 |
| 7,750,239 | B2 | 7/2010 | May | |
| 7,789,689 | B2 | 9/2010 | Frey et al. | |
| 7,804,026 | B2 | 9/2010 | Libby et al. | |
| 7,825,336 | B2 | 11/2010 | Peck | |
| 7,887,349 | B1 | 2/2011 | Macomber | |

* cited by examiner

RECONFIGURABLE ELECTRICAL TERMINAL WITH MULTIPLE CONFIGURATIONS EMPLOYING A CLAMP AND A FASTENER

FIELD OF THE DISCLOSURE

The present disclosure relates generally to a reconfigurable terminal for an electrical receptacle device, and more particularly relates to an apparatus and method for a reconfigurable terminal that can be used with multiple electrical receptacle configurations.

BACKGROUND OF THE INVENTION

Terminals are components of various electrical devices such as receptacles, switches, lampholders, lighting controls, and the like. In the case of electrical receptacles, terminals are used to connect the electrical supply power to the plug blades of an electrical plug. Terminals may directly receive the blades of electrical plugs, or they may supply power to blades of a plug through other electrical components. There are a number of different receptacle blade configurations/geometries such as those configurations standardized by the National Electrical Manufacturers Association (NEMA), and the configuration or orientation of the terminals in the receptacle may vary depending on the blade configuration of the particular receptacle. In addition, different types of electrical receptacles, including surface-mounted receptacles and flush-mounted receptacles, can be of different depths. Thus, the general configuration of a terminal for a specific application may vary as to geometry, orientation and/or size of the terminals in the receptacle in dependence upon the geometry, size and/or depth requirements of the receptacle.

It is not uncommon that different types and/or models of receptacles have different or unique terminal component parts to account for the varying sizes and/or blade configurations. In addition, even one receptacle can include a number of unique terminal component parts to account for the different blade configurations within the one receptacle. These unique terminal component parts that vary by size and/or configuration increase manufacturing complexity and costs.

Therefore, it would desirable to have a universal/reconfigurable terminal that can be used in various types of receptacle devices, where the devices may be of different depths and/or require different blade configurations. It would also be desirable to have a universal/reconfigurable terminal capable of multiple configurations so that multiples of one type of terminal can be used in a single receptacle where multiple terminal configurations are required. A universal/reconfigurable terminal would decrease the number of unique parts required for manufacturing receptacle devices, which would reduce manufacturing complexity and costs, including inventory costs, labor costs, molding costs, etc.

SUMMARY OF THE INVENTION

An electrical receptacle terminal for receiving an electrical plug blade including: a contact portion having a tabbed end including a plurality of tabs and a plug blade end configured to receive said electrical plug blade; a clamp having an aperture and a first notch, wherein the notch is arranged and configured to engage any one of the plurality of tabs of the contact portion; and, a fastener having a surface that is adapted and configured for selectively and securingly engaging the aperture of the clamp. The terminal is capable of being configured into a plurality of configurations depending on which one of the plurality of tabs that the first notch engages.

An electrical receptacle, which includes a plurality of the terminals described above, is disclosed. The receptacle includes a cover plate or cover portion having an opening for one or more sockets with a plurality of apertures to receive an electrical plug, and a base portion that receives the cover plate or cover portion and has a plurality of openings that are each configured to receive one of the terminals. Each of the plurality of terminals is in a terminal configuration position that aligns with one of the apertures in the socket and one of the openings in the base portion.

A method for assembling an electrical receptacle terminal is disclosed. The method includes engaging one of the plurality of tabs of the contact portion with a notch in a clamp, wherein any one of the plurality of tabs engages with the notch according to a desired or predetermined orientation. The method may also include inserting a fastener into an aperture of the clamp, wherein the fastener has a surface that is configured for selectively and securingly engaging the aperture in the clamp.

A method of assembling an electrical receptacle for receiving an electrical plug having a plurality of plug blades with predetermined plug blade orientations is disclosed. The method includes assembling a plurality of terminals having terminal orientations corresponding to the plurality of plug blades, respectively, wherein each terminal assembly includes the steps described above. The method also includes inserting each of the plurality of terminals into one of a plurality of openings in a base portion according to the desired or predetermined orientation.

BRIEF DESCRIPTION OF THE DRAWINGS

One or more aspects of the present invention are particularly pointed out and distinctly claimed as examples in the claims at the conclusion of the specification. The foregoing and other objects, features, and advantages of the present invention may be more readily understood by one skilled in the art with reference being had to the following detailed description of several embodiments thereof, taken in conjunction with the accompanying drawings wherein like elements are designated by identical reference numerals throughout the several views, and in which:

DETAILED DESCRIPTION

The present disclosure describes a terminal for a wiring device such as an electrical receptacle, wherein the electrical receptacle receives plug blades of an electrical plug. Embodiments will be described below while referencing the accompanying figures. The accompanying figures are merely examples and are not intended to limit the scope of the present disclosure. The terminal can be employed on any suitable wiring device such as but not limited to receptacles, switches, lighting/fan speed controls, dimmers, HVAC equipment/controllers, and the like.

Figure 1:
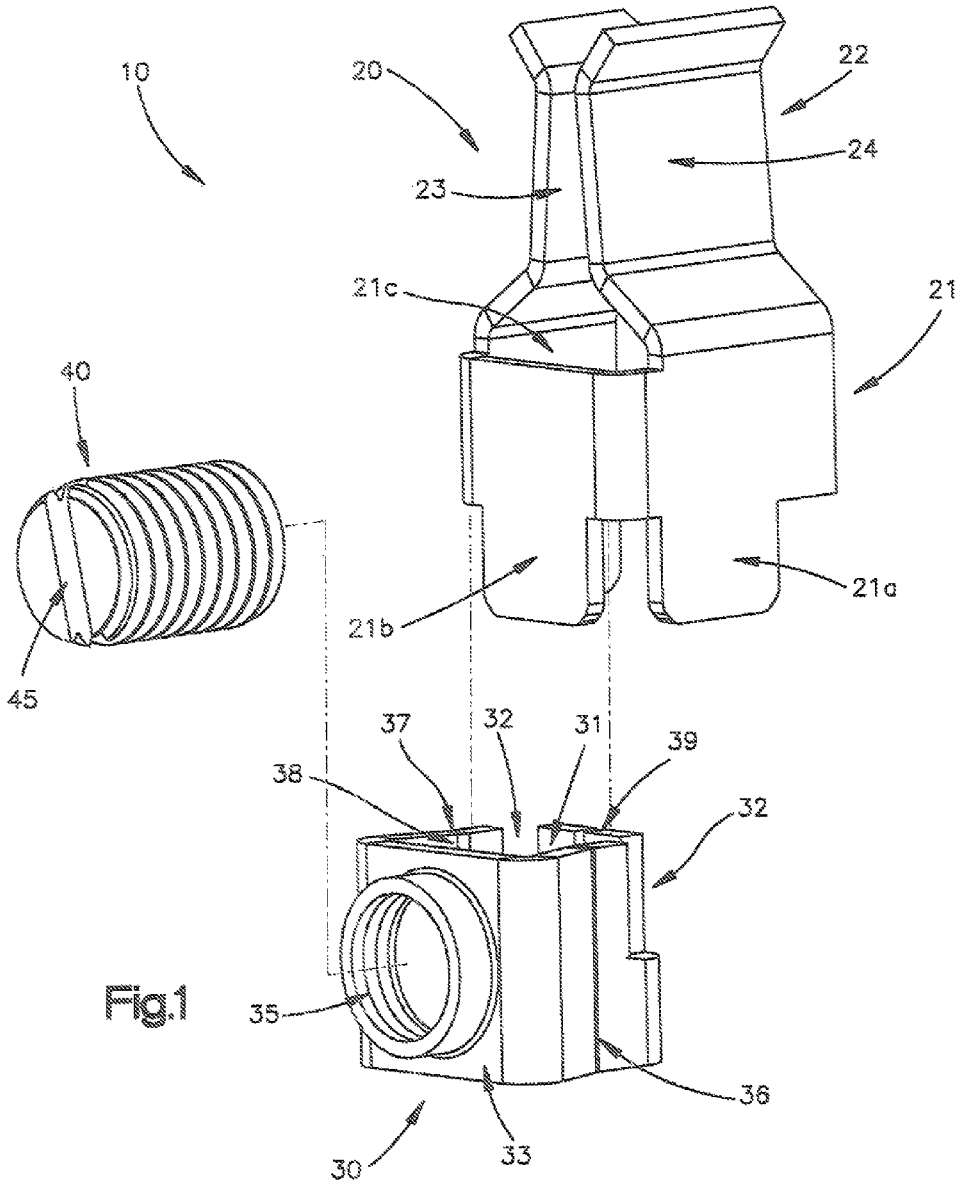
FIG. 1 is an exploded view of a terminal according to one embodiment of the present invention, including a contact portion, a clamp, and a fastener.
Figure 2:
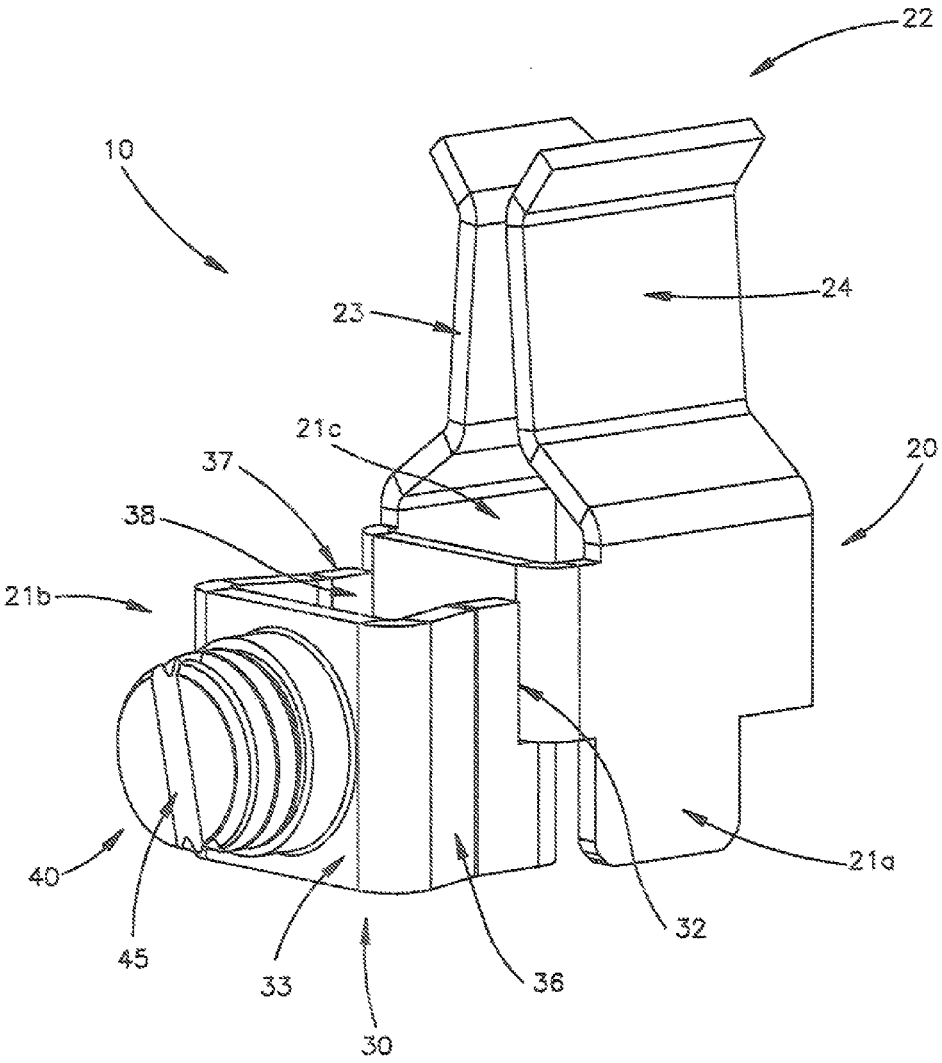
FIG. 2 is an isometric view of the terminal shown in FIG. 1, wherein the terminal is in a first terminal configuration position.

FIGS. 1-2 show an exemplary embodiment of a terminal 10. FIG. 1 shows an exploded view of terminal 10 to show the terminal components separately, and FIG. 2 shows terminal 10 with the components assembled. In this exemplary embodiment, terminal 10 includes a contact portion 20, a clamp 30, and a fastener 40. The contact portion 20 includes a first end 21 that has a plurality of tabs 21*a*, 21*b*, 21*c*. The exemplary embodiment includes three tabs; however it will be understood by those skilled in the art that the contact portion may include any number of tabs, including but not limited to one tab, two tabs, three tabs, and four tabs, etc. In addition, the tabs may be any one or more of a plurality of different forms, a plurality of different shapes, a plurality of different sizes, etc.

Contact portion 20 has a second end 22 that includes two jaws 23, 24. Jaws 23, 24 are configured to receive a plug blade from an electrical plug (not shown). The ends of the jaws 23, 24 are outwardly directed, as shown in FIGS. 1-2, to facilitate entry of the prong between jaws 23, 24. Jaws 23, 24 may be configured to accept straight plug blades, L-shaped blades, round blades, or any other suitably shaped blades. In addition, the plug blade can be equivalent to a plug prong, ground pin, ground prong, and the like. The contact portion may be a ground contact portion or a power contact portion (phase or neutral).

Contact portion 20 may be composed of any suitable metal or combination of metals, including but not limited to, brass, copper, tin, plated brass, plated copper, any suitable alloy/combination thereof, etc. The plating material may be any suitable material such as, but not limited to, tin. For example, by tin plating the contact, the contact can be made to be compatible with aluminum conductors, thus allowing the requirements of Underwriters Laboratories (UL) standards to be met. The contact portion can be produced from a sheet of metal that is shaped and/or bent into the geometry and/or size of the requirements for the contact portion. In addition, the contact portion can be assembled using a mold and/or by using multiple component pieces of metal, or by any other suitable means or method now known or hereafter developed to those skilled in the art.

As depicted in FIG. 1, clamp 30 may include a first wall 36, a second wall 37, a third wall 31, and a fourth wall 33. The fourth wall 33 includes an aperture 35, which is configured to securingly receive a fastener 40. The third wall 31 may be comprised of one section or multiple sections. As shown in the embodiment in FIG. 1, if the third wall 31 is comprised of multiple sections, then the sections may be separated by one or more optional gaps 39. There are several advantages of the clamp 30 containing optional gap 39 in third wall 31. One advantage of optional gap 39 is that it may decrease the complexity of manufacturing the clamp 30. In addition, optional gap 39 allows the clamp 30 to be tolerant or capable of handling more flex than if the third wall 31 is comprised of one section.

In the exemplary embodiment, first wall 36 and second wall 37 are sloped and angled inward towards third wall 31. However, it should be understood that the walls of clamp 30 need not necessarily be sloped and/or angled, may have slopes of differing angles, may include compound slopes/angles, etc. The length of the walls, angles, and/or wall slopes of the clamp walls may also be the reverse of what is illustrated in the exemplary embodiment. For example, the third wall 31 that includes the notch may be longer than the fourth wall 33 that includes the aperture, the angle between the first wall 36 and the fourth wall 33 may be wider or equal to the angle between the first wall 36 and third wall 31, etc. In addition, it should be understood that the clamp need not necessarily include defined walls. For example, the clamp may be a cylindrical clasp or ring-shaped, include a portion that is cylindrical shaped and a portion that is a wall(s), etc.

First wall 36 and/or second wall 37 may include at least part of first notch 32. In the exemplary embodiment, first wall 36 and second wall 37 each include a portion of the notch 32. However, it should be understood by those skilled in the art that only one of the first and second walls may include at least part of the notch.

First notch 32 is configured to engage tab 21*b* of contact portion 20. When tab 21*b* (or 21*a*, 21*c*) is engaged with notch 32, X and Y are substantially perpendicular to one another (see FIG. 5). Notch 32 of clamp 30 is configured to receive any one of the plurality of tabs 21*a*, 21*b*, 21*c* of the contact portion 20. Fastener 40 has a surface that is adapted and configured to selectively and securingly engage aperture 35 of clamp 30.

The space between the first wall 36 and the second wall 37 preferably forms a channel 38 for receiving a wire/conductor. The channel 38 allows for a conductor to be received between the first wall 36 and the second wall 37. Preferably, the narrowest part of the channel 38 is wider than the widest conductor that may be received into the channel 38. In some embodiments, fastener 40 is in contact, or interferes with, first wall 36 and/or second wall 37.

Clamp 30 may be composed of any suitable metal, including but not limited to, a steel-plated material, a zinc-plated material, etc. One advantage of using a zinc-plated material is to provide corrosion resistance. Thus, zinc-plating the clamp 30 alleviates the potential issue of corrosion and/or a galvanic reaction due to a contact portion 20 composed of a brass-type material in contact with the clamp 30 composed of a steel-type material. Using a steel-plated material reduces deformation or buckling of the clamp 30 when engaged with the contact portion 20.

Aperture 35 may include "thread-like" features, and fastener 40 may thread into aperture 35 of clamp 30. In addition to or in alternative to the threads in the aperture, first wall 36 and/or second wall 37 may include "thread-like" features which may engage the threads of fastener 40. In other words, the threads in first wall 36 and second wall 37 may form threads which engage at least a portion of fastener 40, even though they may not totally encircle fastener 40. In addition, the walls of the clamp may include "thread-like" features even if the walls are not angled/sloped and even if the clamp is another shape, including, but not limited to ring-shaped, cylindrical, etc.

Fastener 40 may be, but is not limited to, a set screw, a self-tapping screw, clasp, pin, stud, rod, bolt, etc. In addition, fastener 40 may be configured to be driven by any suitable drive configuration, such as, but not limited to, an allen/hex drive, slotted/straight blade drive, Phillips/cross drive, 6-point star/torx drive, square/Robertson drive, or the like. In addition, fastener 40 may have any suitable type of head, or it may be headless as in the case of a set screw. A screw driver or other suitable tool (not shown) may engage groove 45 of the fastener 40. The selection of the drive type for fastener 40 may depend on the intended application and torque requirements of fastener 40. For example, there may be a predefined torque range for a given terminal or application. For example, a minimum amount of torque may be required to ensure a low resistance electrical connection that is also mechanically secure. Conversely, the torque should not exceed a maximum value in order to avoid undesirable deformation. The use of a slotted drive may ensure that sufficient torque is applied while preventing excessive torque. Similarly, a Phillips drive may also be used to prevent excessive torque. One inherent feature of a Phillips drive is that the Phillips bit will cam out of the drive recess above a certain torque. This cam out behavior can be used to ensure excessive torque is not applied.

FIG. 2 shows the components of the terminal 10 in an assembled position. More specifically, the terminal 10 in FIG. 2 is assembled in a first terminal configuration position. To obtain the first terminal configuration position, a first tab 21*b* of the contact portion 20 is engaged with first notch 32 of clamp 30. When tab 21*b* is engaged with notch 32 of clamp 30, X is substantially perpendicular to Y (see FIG. 5). Thus, the contact portion 20 is adjacent to, or in a side position in relation to, the clamp 30.

There are several advantages to the contact portion 20 being positioned substantially perpendicular to the clamp 30, as opposed to a conventional terminal where the contact portion is stacked in line with the clamp. One advantage is that the height of the terminals in the disclosed invention may be less than the height of a conventional terminal. Thus, the same terminal can be used in different types of electrical receptacles that have varying depth restrictions, including but not limited to, flush-mount receptacles, surface-mount receptacles, etc. Advantages of reducing the number of unique terminal parts required among different types of receptacles include automating production as well as cutting manufacturing costs, complexity, inventory, etc.

Another advantage of the clamp 30 being in a substantially perpendicular position to the contact portion 20 (and the contact portion 20 having a plurality of tabs) is that the same components of terminal 10 can be assembled in a variety of different configurations. Thus, if an electrical receptacle (see FIG. 7) includes a plurality of blade configurations that require various terminal configurations, then multiples of the same terminal components can be used and just assembled in a different configuration to match each of the respective blade configurations.

The configuration of the terminal is dependent on which one of the plurality of tabs 21*a*, 21*b*, 21*c* is engaged in the first notch 32 of clamp 30. That is, when one of the plurality of tabs 21*a*, 21*b*, 21*c* is engaged with the notch 32, there is a different configuration position than when any other one of the plurality of tabs 21*a*, 21*b*, 21*c* is engaged with notch 32. For example, in the exemplary embodiment, when a first tab 21*b* is engaged with notch 32, the terminal is in a first terminal configuration position (as shown in FIG. 2). When a second tab 21*a* is engaged with notch 32, the terminal is in a second terminal configuration (as shown in FIG. 3A). Lastly, when a third tab 21*c* is engaged with notch 32, the terminal is in a third terminal configuration position (see FIG. 3B). In each of these configurations, the contact portion 20 is substantially perpendicular to the clamp 30. It should be noted that the number of configuration positions is not limited to three. Rather, the number of potential configurations positions is dependent on the number of tabs on the contact portion, which may be any number of tabs, including but not limited to, one tab, two tabs, three tabs, four tabs, etc.

The ability to configure the terminal in a plurality of different configuration positions allows for one or more terminals in an electrical receptacle to each have the same components (i.e. contact portion 20, clamp 30, and fastener 40) because each terminal can be assembled in a configuration position that would match the configuration of each plug blade aperture in the socket (not shown).

Tabs 21*a*, 21*b*, and 21*c* provide structural joint support when they are engaged with first notch 32 of clamp 30. Torque ratings of the disclosed invention maintains or exceeds torque ratings in conventional terminals for a two-piece device.

As shown in the exemplary embodiment of FIG. 2, fastener 40 securingly engages the aperture in clamp 30, positioning the fastener 40 in channel 38 of clamp 30 in between the first wall 36 and the second wall 37. In some embodiments, fastener 40 is in contact, or interferes with, first wall 36 and/or second wall 37. Fastener 40 is configured to engage with a conductor (see FIG. 6) that may be in the channel 38. In the exemplary embodiment, when a conductor is in channel 38, fastener 40 is substantially perpendicular to the conductor. In alternate embodiments, the fastener is configured to engage the conductor, but is not necessarily substantially perpendicular to the conductor. Fastener 40 may be tightened a suitable amount so that the conductor presses against one of the plurality of tabs 21*a*, 21*b*, 21*c* that is engaged with notch 32 of clamp 30, keeping the conductor in place while in the channel 38. When tightening, fastener 40 is rotated in a suitable direction and further advanced until the conductor is firmly secured between the fastener and the contact portion.

In another embodiment, the terminal may be a ground terminal. For ground terminals, the clamp component may be the same clamp component as the exemplary embodiment in FIGS. 1-2. In addition, the fastener component of a ground terminal may be the same type of fastener components as the exemplary embodiments in FIGS. 1-2. Thus, if a receptacle has one or more terminals for straight blades and one or more ground terminals, the clamp component in the ground terminal can be the same type of clamp component as used in the straight blade terminals; and the fastener component in the ground terminal can be the same type of fastener component as used in the straight blade terminals. An example of a ground terminal is ground terminal 130 in FIG. 7 (discussed in more detail below).

The contact portion of ground terminals may differ from the contact portion of the terminals in the exemplary embodiments in FIGS. 1-2. The geometry of the jaws of the contact portion for a ground terminal is the same as the geometry of the jaws of the contact portions in the terminal described above in the exemplary embodiment; however, the width between the jaws in the contact portion of a ground terminal is greater than the width between the jaws in the contact portion of the terminal of the exemplary embodiment. This difference in width in the contact portion for the ground terminal accounts for the geometry and size differences of a ground pin of an electrical plug.

Figure 3B:
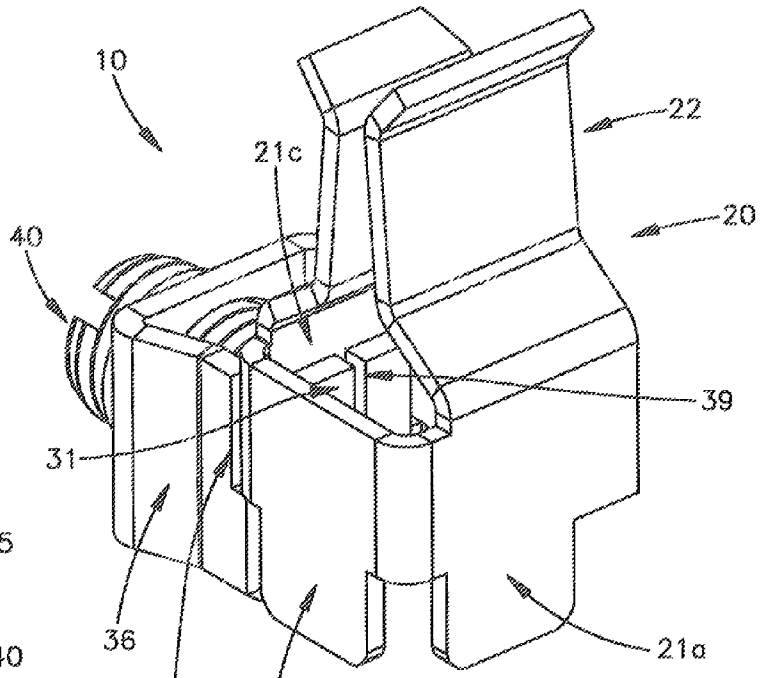
FIG. 3B is an isometric view of the terminal shown in FIG. 1, wherein the terminal is in a third terminal configuration position.
Figure 3A:
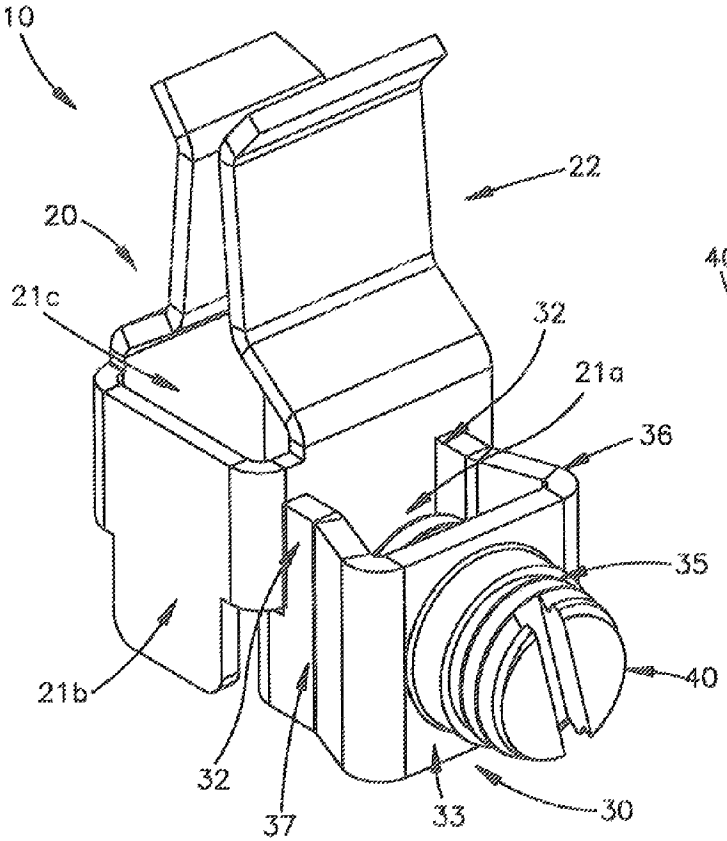
FIG. 3A is an isometric view of the terminal shown in FIG. 1, wherein the terminal is in a second terminal configuration position.

FIG. 3A and FIG. 3B are perspective isometric views of terminals in other configuration positions. FIG. 3A shows terminal 10 in a second terminal configuration position. In the second terminal configuration position, tab 21*a* of contact portion 20 is engaged with notch 32 of clamp 30. Aperture 35 of clamp 30 receives fastener 40. A conductor (not shown) may be placed in channel 38 between first wall 36 and second wall 37, and fastener 40 may be tightened a suitable amount to press the conductor against tab 21*a* of contact portion 20.

FIG. 3B shows terminal 10 in a third terminal configuration position. In the third terminal configuration position, tab 21*c* of contact portion 20 is engaged with first notch 32 of clamp 30. Similar to the other configuration positions, aperture 35 of clamp 30 receives fastener 40. However, when a conductor is placed in channel 38 of clamp 30 and fastener 40 is tightened a suitable amount, fastener 40 presses the conductor against tab 21*c* of contact portion 20.

Figure 4B:
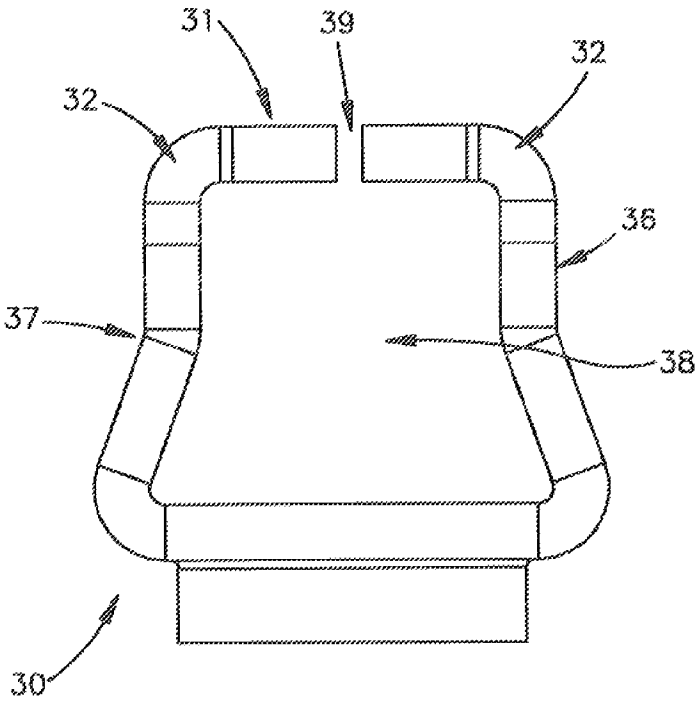
FIG. 4B is a top view of the clamp shown in FIG. 1.
Figure 4A:
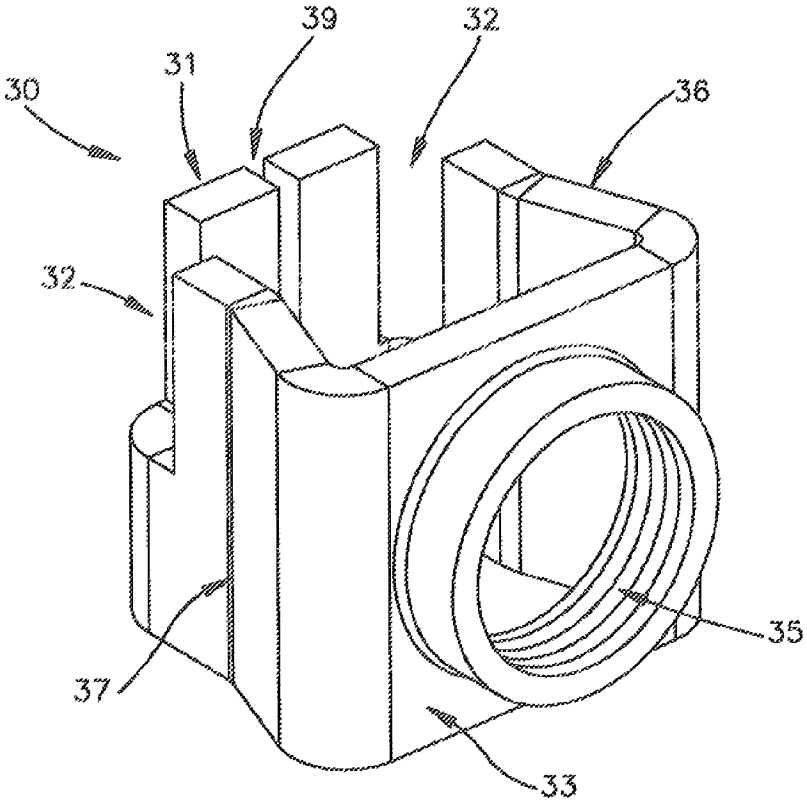
FIG. 4A is an isometric view of the clamp shown in FIG. 1.

FIG. 4A is a perspective isometric view of clamp 30. Clamp 30 in FIG. 4A is the same view as clamp 30 in terminal 10 of FIG. 3A, which is in the second terminal configuration position. In this embodiment, notch 32 extends through a portion of first wall 36 and second wall 37. Notch 32 only extend partially through the respective walls, as first wall 36 is still attached to third wall 31, and second wall 37 is still attached to third wall 31.

FIG. 4B is a top view of clamp 30. First wall 36 slopes in an inward direction from fourth wall 33 towards third wall 31. Second wall 37 slopes in an inward direction from fourth wall 33 towards third wall 31. Third wall 31 is comprised of two sections, which are separated by optional gap 39. Channel 38 is configured to receive a conductor (not shown).

Figure 5:
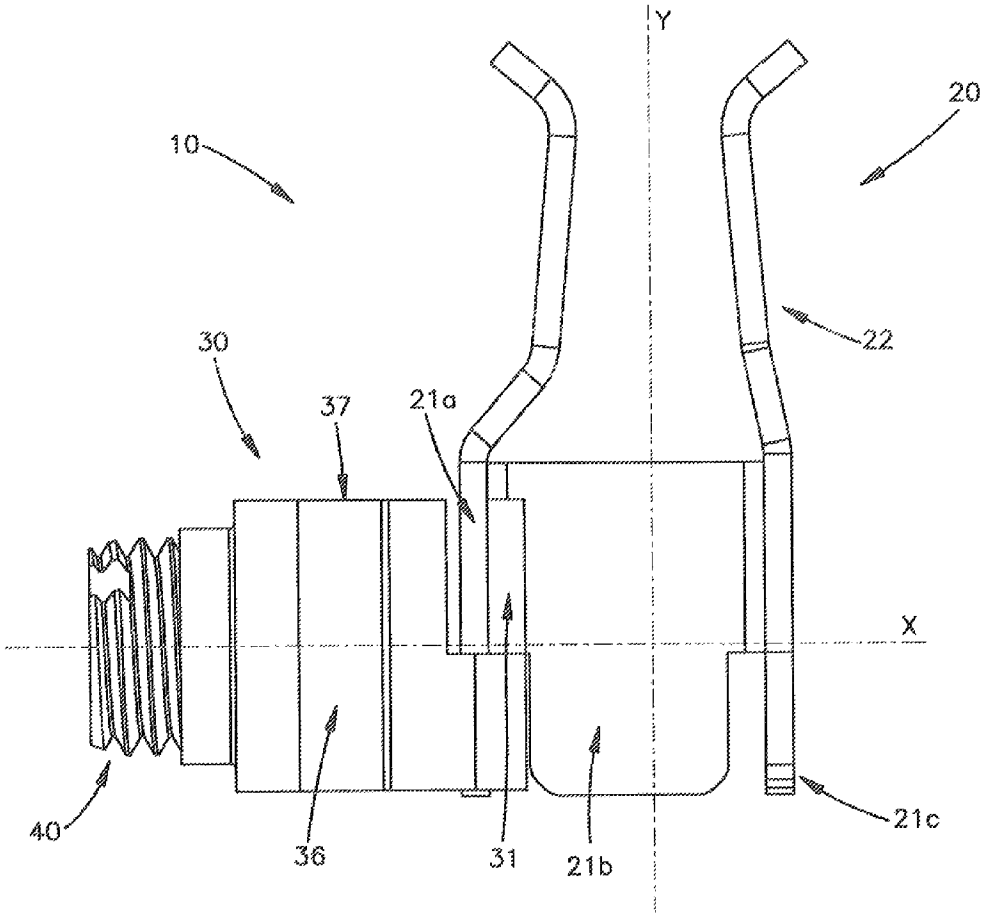
FIG. 5 is a side view of the terminal shown in FIG. 3A, wherein the terminal is in a second terminal configuration position.

FIG. 5 shows a side view of terminal 10 that is in the second terminal configuration position (same configuration as terminal 10 in FIG. 3A). Tab 21*a* of contact portion 20 is engaged with notch 32 of clamp 30, where the contact portion is substantially perpendicular to clamp 30. When tab 21*a* is engaged with notch 32, X is substantially perpendicular to Y. Aperture 35 of clamp 30 receives fastener 40.

Figure 6:
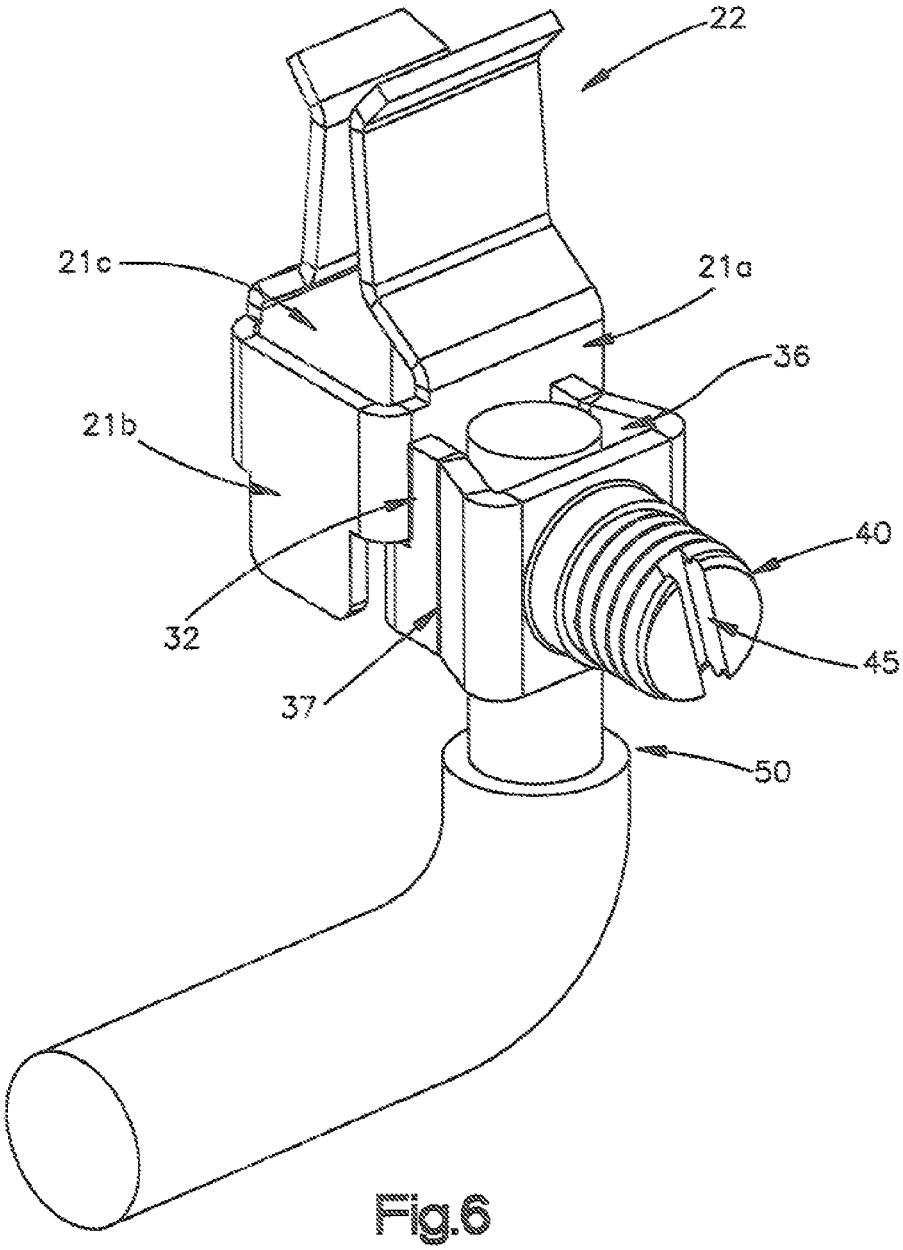
FIG. 6 is the terminal shown in FIG. 3A, including a conductor in the channel of the terminal clamp.

FIG. 6 is an exemplary embodiment of terminal 10 with a conductor 50, wherein terminal 10 is configured in a second terminal configuration position. The first wall 36 and the second wall 37 of clamp 30 are configured to receive a bared end of conductor 50. In addition, fastener 40 is configured to engage conductor 50. Fastener 40 is tightened a suitable amount so that conductor 50 is pressed between fastener 40 and one of the plurality of tabs 21*a*, 21*b*, 21*c* that is engaged with clamp 30, which in this embodiment is tab 21*a*. As fastener 40 is tightened, it forces the bared end of conductor 50 against tab 21*a* of contact portion 20, thus retaining the conductor 50 in the channel 38 of clamp 30, ensuring a good electrical connection.

The method of assembling an electrical receptacle terminal 10 for receiving an electrical plug blade includes engaging one of a plurality of tabs 21*a*, 21*b*, 21*c* of a contact portion 20 with first notch 32 of clamp 30, wherein the clamp includes a first notch 32 and an aperture 35; and inserting a fastener into aperture 35 of clamp 30. When assembled, contact portion 20 is substantially perpendicular to clamp 30. Any one of the plurality of tabs 21*a*, 21*b*, 21*c* of the contact portion 20 may engage notch 32 of clamp 30. The one of the plurality of tabs 21*a*, 21*b*, 21*c* chosen to engage with notch 32 depends on the desired or predetermined orientation (i.e. first terminal configuration position, second terminal configuration position, third terminal configuration position) of terminal 10.

In the method of assembling a terminal, the terminal may be a ground terminal, which includes a ground contact portion configured to receive a ground pin. The ground contact portion may, but not necessarily, have the same geometry as contact portions 20, but may have a wider spacing between the jaws to receive a ground pin. The clamp used in the ground terminal may be the same as the clamp 30 used in terminal 10, and the fastener may be the same as the fastener 40 used in terminal 10.

Figure 7:
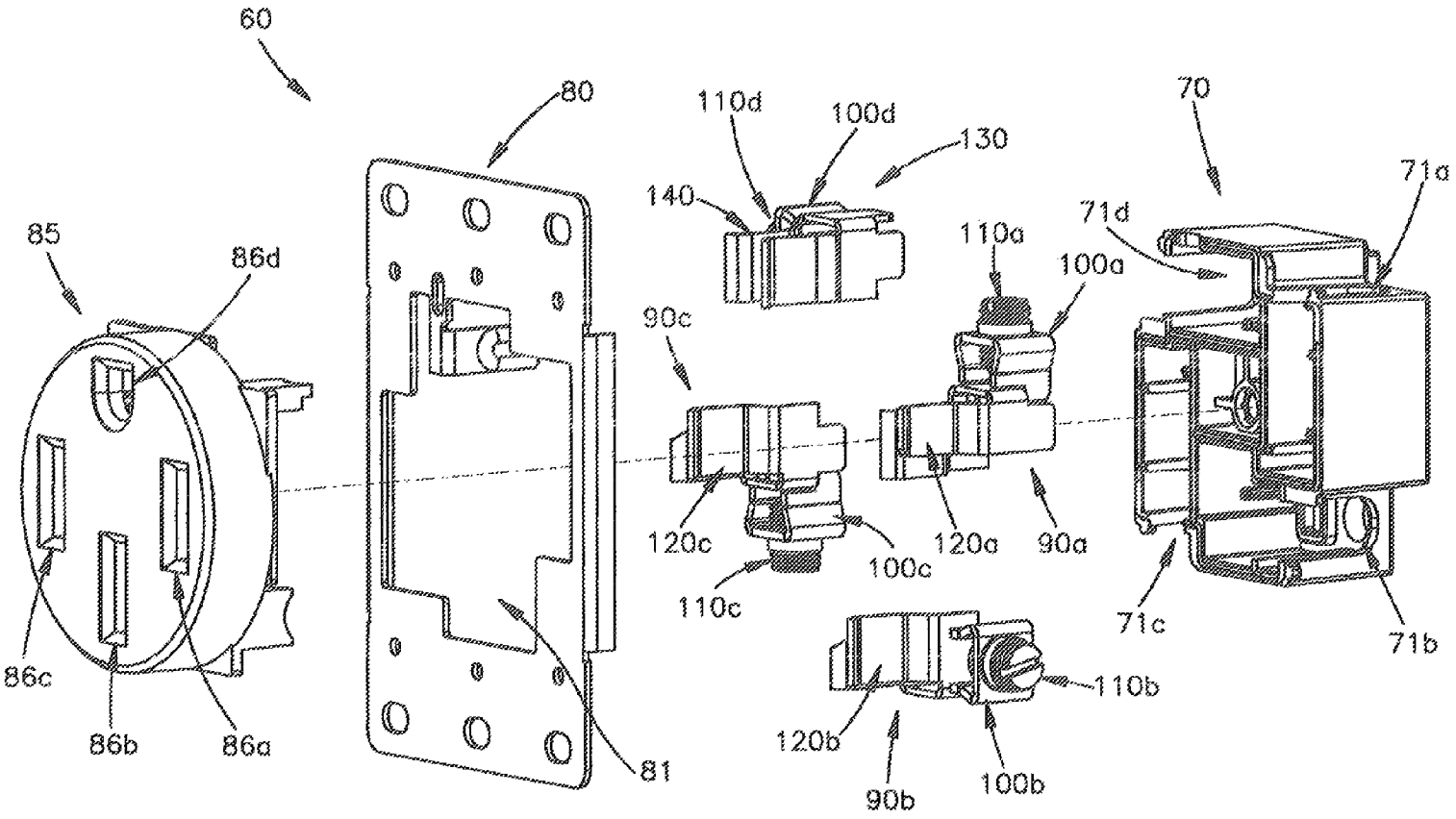
FIG. 7 is an exploded view of one embodiment of an electrical receptacle, including a plurality of terminals of the present invention.

FIG. 7 is an exemplary embodiment of an electrical receptacle 60, wherein a plurality of terminals 90*a*, 90*b*, 90*c* and a ground terminal 130 are incorporated in the embodiment of electrical receptacle 60. In this exemplary embodiment, the receptacle 60 includes: a base portion 70; a cover plate or cover portion 80; a socket 85; a plurality of terminals 90*a*, 90*b*, 90*c*; and a ground terminal 130.

Terminals 90*a*, 90*b*, 90*c*, 130 are each assembled and positioned in accordance with their function and the plug/receptacle configuration. Each of the respective terminals 90*a*, 90*b*, 90*c* (non-ground terminals), may, but not necessarily, include substantially identical components. These components of the respective terminals 90*a*, 90*b*, 90*c* include: a contact portion 120*a*, 120*b*, 120*c*; a clamp 100*a*, 100*b*, 100*c*; and a fastener 110*a*, 110*b*, 110*c*. However, the configurations of these components may vary by terminal 90*a*, 90*b*, 90*c*. Clamp 100*d* of ground terminal 130 may, but not necessarily, be substantially identical to clamps 100*a*, 100*b*, 100*c*; and, fastener 110*d* of ground terminal 130 may, but not necessarily, be substantially identical to fasteners 110*a*, 110*b*, 110*c*.

Contact portions 120*a*, 120*b*, 120*c* of terminals 90*a*, 90*b*, 90*c* each include a first end with a plurality of tabs. In this embodiment, the geometry and number of the tabs of the contact portions 120*a*, 120*b*, 120*c* are similar to the geometry described and shown in the exemplary embodiments in FIGS. 1-6; however, it will be understood by those skilled in the art that the tabs on the contact portions can be of any form, shape number, and/or size. As described in the embodiments above, each contact portion 120*a*, 120*b*, 120*c* also has a second end that is configured to receive a plug blade. This second end of contact portion 120*a*, 120*b*, 120*c* may include two jaws configured for a prong of an electrical plug to be received. The ends of each jaw may have a bend that are directed outward to facilitate entry of the prong between the jaws. In this exemplary embodiment, terminals 90*a*, 90*b*, 90*c* are configured and arranged to receive the flat straight prongs of an electrical plug. However, terminals may be configured to receive other types of prongs that may be of different shapes, sizes, etc. For example, terminals may be configured to accept L-shaped prongs, round prongs, or any other suitably shaped prongs (see FIGS. 8A-8G).

Clamps 100*a*, 100*b*, 100*c* (and 100*d*) may each be substantially identical and are similar to the geometry and features described and shown in the embodiments of FIGS. 1-6. It should be understood that the plurality of clamps do not necessarily have to be substantially identical. As further described in the embodiments above, each of clamps 100*a*, 100*b*, 100*c* (and 100*d*) include a first notch and an aperture, wherein each of the notches in clamps 100*a*, 100*b*, 100*c* are configured to mate with any one of the plurality of tabs of the respective contact portion 120*a*, 120*b*, 120*c*; and, each of the apertures of clamps 100*a*, 100*b*, 100*c* (and 100*d*) are configured to receive the respective fastener 110*a*, 110*b*, 110*c* (and 110*d*). Thus, clamps 100*a*, 100*b*, 100*c*, 100*d* are interchangeable among one another.

Fasteners 110*a*, 110*b*, 110*c*, 110*d* may, but not necessarily, be substantially identical to one another and are similar to the features described and shown in the embodiments of FIGS. 1-6. Thus, fasteners 110*a*, 110*b*, 110*c*, 110*d* are interchangeable among one another. Fasteners 110*a*, 110*b*, 110*c*, 110*d* are received by the respective apertures in the clamps 100*a*,

100*b*, 100*c*, 100*d*. After conductors (not shown) are placed in one or more of the channels of clamps 100*a*, 100*b*, 100*c*, 100*d*, then the fasteners 110*a*, 110*b*, 110*c*, 110*d* are tightened a suitable amount so that each of the conductors is pressed between the respective fastener 110*a*, 110*b*, 110*c*, 110*d* and one of the tabs of the respective contact portion 120*a*, 120*b*, 120*c*, 140. The tab of the respective contact portion that is in contact with the conductor is the tab that is engaged in the notch of the respective clamp. For example, a conductor may be placed in the channel of clamp 100*a*. Fastener 110*a* may be tightened a suitable amount so that the conductor is pressed against the tab of contact 120*a* that is engaged with the notch in clamp 100*a*, thus retaining the conductor in the channel of clamp 100*a* and ensuring a good electrical connection.

When each of the terminals 90*a*, 90*b*, 90*c*, 130 are assembled, each of the contact portions 120*a*, 120*b*, 120*c*, 140 are substantially perpendicular to each of the respective clamps 100*a*, 100*b*, 100*c*, 100*d*. The configuration position of the terminals 90*a*, 90*b*, 90*c*, 130 is dependent on which one of the plurality of tabs of the contact portion 120*a*, 120*b*, 120*c*, 140 engages with the notches in the clamps 100*a*, 100*b*, 100*c*, 100*d*, respectively.

A difference between the plurality of terminals 90*a*, 90*b*, 90*c* may be the configurations of the components. The configurations of the components in each terminal 90*a*, 90*b*, 90*c* may differ according to the respective configuration of each the plurality of apertures 86*a*, 86*b*, 86*c* in socket 85 and/or openings 70*a*, 70*b*, 70*c* in base portion 70. In other words, contact portions 120*a*, 120*b*, 120*c* may, but not necessarily, be each substantially identical; clamps 100*a*, 100*b*, 100*c* may, but not necessarily, be each substantially identical; and, fasteners 110*a*, 110*b*, 110*c* may, but not necessarily, be each substantially identical. But the way each respective contact portion 120*a*, 120*b*, 120*c* is coupled to each respective clamp 100*a*, 100*b*, 100*c* may differ to obtain the required configuration needed to align with the apertures 86*a*, 86*b*, 86*c* in socket 85 and the openings 71*a*, 71*b*, 71*c* in base portion 70. In order for clamp 100*a* of terminal 90*a* to align with opening 71*a* of base portion 70, and for contact portion 120*a* of terminal 90*a* to align with aperture 86*a* of socket 85, the terminal 90*a* is assembled in a first terminal configuration position (see FIG. 2). Likewise, terminal 90*c* is also assembled in a first terminal configuration position (see FIG. 2) so that clamp 100*c* of terminal 90*c* aligns with opening 71*c* of base portion 70, and contact portion 120*c* of terminal 90*c* aligns with aperture 86*c* of socket 85. Terminal 90*b* is assembled in a second terminal configuration position (see FIG. 3A) so that clamp 100*b* of terminal 90*b* aligns with opening 71*b* of base portion 70, and contact portion 120*b* of terminal 90*b* aligns with aperture 86*b* of socket 85. Lastly, ground terminal 130 is assembled in a third terminal configuration position (see FIG. 3B) so that clamp 100*d* aligns with opening 71*d* of base portion and ground contact portion 140 aligns with aperture 86*d* in socket 85.

Ground terminal 130 is configured to receive the ground pin of an electrical plug. Ground terminal 130 has a clamp 100*d*, which may, but not necessarily, be substantially identical to the clamps 100*a*, 100*b*, 100*c* of the other terminals 90*a*, 90*b*, 90*c*. In addition, ground terminal 130 has a fastener 110*d*, which may, but not necessarily, be substantially identical to the fasteners 110*a*, 110*b*, 110*c* of the other terminals 90*a*, 90*b*, 90*c*. A difference between the components of the ground terminal 130 and the components of the other terminals 90*a*, 90*b*, 90*c* is the contact portion. Ground contact portion 140 may, but not necessarily, have the same geometry as the other contact portions 90*a*, 90*b*, 90*c*; however, ground contact portion 140 may differ from the other contact portions 90*a*, 90*b*, 90*c* in that the spacing or width between the jaws in the ground contact portion 140 is wider than the spacing or width between the jaws in the other contact portions 90*a*, 90*b*, 90*c*. The wider spacing between the jaws in the ground contact portion 140 accounts for the difference in sizing of the ground pin.

FIG. 7 is an embodiment of an electrical receptacle that includes four terminals in particular configurations. It should be noted that this is an exemplary embodiment, and a different number of terminals and a number of different configurations may be used. The number of terminals used may depend on, but not limited to, NEMA standards, the type of receptacle or other electrical device, the number of plug blades, the number of sockets in the receptacle, etc. The configuration of the terminals depends on the configurations of the apertures in the socket and/or openings in the base portion, which may depend on the type of receptacle. In addition, if the type of receptacle includes one or more openings for ground pins, then one or more of the terminals may be a ground terminal. It also should be noted that each of the contact portions in the terminals in the exemplary embodiment of FIG. 7 have three tabs; however, it will be understood by those skilled in the art that the contact portion may include any number of tabs, including, but not limited to, one tab, two tabs, three tabs, and four tabs, etc.

Base portion 70 includes a plurality of openings 71*a*, 71*b*, 71*c*, 71*d*. Each of these openings 71*a*, 71*b*, 71*c*, 71*d* are configured to receive a terminal 90*a*, 90*b*, 90*c*, 130. More specifically, opening 71*a* receives terminal 90*a*, opening 71*b* receives 90*b*, opening 71*c* receives terminal 90*c*, and opening 71*d* receives ground terminal 130. When terminals 71*a*, 71*b*, 71*c*, 71*d* are inserted into base portion 70, the outer edges of fasteners 110*a*, 110*b*, 110*c*, 110*d* are exposed to the external environment due to the openings 71*a*, 71*b*, 71*c*, 71*d* of the base portion 70. This exposure allows fasteners 110*a*, 110*b*, 110*c*, 110*d* to be loosened and tightened accordingly when the receptacle 60 is in an assembled position.

The electrical receptacle shown in FIG. 7 includes cover plate or cover portion 80. Cover plate or cover portion 80 includes an aperture for one of more sockets 85. The type and/or size of cover plate used may vary depending on the type of receptacle (i.e. flush-mount receptacle, surface mount receptacle, etc.), size of receptacle, number of sockets (i.e. one, two, three, etc.) in the receptacle, etc. Cover plate or cover portion 80 is configured to align and engage with base portion 70.

Socket 85 includes a plurality of apertures 86*a*, 86*b*, 86*c*, 86*d* so that plug blades of an appropriate electrical plug (not shown) can be inserted through the apertures 86*a*, 86*b*, 86*c*, 86*d* and into engagement with the contact portions 120*a*, 120*b*, 120*c*, 140 of terminals 90*a*, 90*b*, 90*c*, 130. In this exemplary embodiment, one of the apertures 86*d* in socket 85 is configured to receive a ground pin (not shown). Ground terminal 130 is configured to align with the ground aperture 86*d* in socket 85. The embodiment in FIG. 7 includes one socket, but there can be any number of sockets in the receptacle. In addition, the socket may have any number and any configuration of apertures, depending on a variety of factors, including but not limited to, NEMA standards, the type of electrical plug, the type of electrical receptacle, etc. (See FIG. 8 for other exemplary configurations of socket configurations.)

The method of assembling an electrical receptacle 60, which receives a plurality of plug blades includes assembling a plurality of terminals 90*a*, 90*b*, 90*c*, 130, and aligning each of the plurality of terminals 90*a*, 90*b*, 90*c*, 130 with one of a plurality of openings 71*a*, 71*b*, 71*c*, 71*d* in a base portion 70.

Each of terminals 90*a*, 90*b*, 90*c*, 130 are assembled according to the method described in detail above, and then inserted into base portion 70 according to their function, desired or predetermined orientation, etc. As discussed above, assembling each of the plurality of terminals 90*a*, 90*b*, 90*c*, 130 includes engaging one of a plurality of tabs of a contact portion 120*a*, 120*b*, 120*c*, 140 with the notch of a respective clamp 100*a*, 100*b*, 100*c*, 100*d*, respectively. Each of the terminals 90*a*, 90*b*, 90*c*, 130 include an end with a plurality of tabs, and each of the clamps 100*a*, 100*b*, 100*c*, 100*d* includes a notch on one end and an aperture on the opposite end. Each of the contact portions 120*a*, 120*b*, 120*c*, 140 engages with each respective clamp 100*a*, 100*b*, 100*c*, 100*d* resulting in each of the contact portions 120*a*, 120*b*, 120*c*, 140 being in a substantially perpendicular position to each of the respective clamps 100*a*, 100*b*, 100*c*, 100*d*. Any one of the plurality of tabs on the contact portion 120*a*, 120*b*, 120*c*, 140 may engage the notch of the respective clamp 100*a*, 100*b*, 100*c*, 100*d*, the tab chosen being the one that allows the terminal 90*a*, 90*b*, 90*c*, 130 to align with the desired or predetermined orientation required to align with the respective openings 71*a*, 71*b*, 71*c*, 71*d* of base portion 70 and/or the plurality of apertures 86*a*, 86*b*, 86*c*, 86*d* in socket 85. Fasteners 100*a*, 100*b*, 100*c*, 100*d* are then inserted into each of the apertures of clamp 100*a*, 100*b*, 100*c*, 100*d*.

In the method of assembling the electrical receptacle, one of the terminals may be a ground terminal 130, which includes a ground contact portion 140 configured to receive a ground pin. The ground contact portion 140 may have the same geometry as the other contact portions 120*a*, 120*b*, 120*c*, but has a wider spacing between the jaws to account for a ground pin. The clamp 100*d* and the fastener 110*d* may be the same clamp and fastener used in the other terminals 90*a*, 90*b*, 90*c*.

According to the method of assembling the electrical receptacle, the plurality of terminals 90*a*, 90*b*, 90*c*, 130 are each aligned with one of a plurality of openings 71*a*, 71*b*, 71*c*, 71*d* in the base portion according to the desired or predetermined orientation, and each of the plurality of terminals 90*a*, 90*b*, 90*c*, 130 is inserted into the base portion 70. For example, opening 71*a* of base portion 70 is positioned in such a way that a terminal in the first terminal configuration position (see FIG. 2) is required. Thus, terminal 90*a* is assembled in a manner to obtain the first terminal configuration position before the terminal 90*a* is inserted into the base portion. The orientation of opening 71*b* of base portion 70 requires a terminal to be in a second terminal configuration position (see FIG. 3A), so the contact portion and clamp of terminal 90*b* is assembled to obtain a second terminal configuration position. The opening 71*c* in base portion 70 requires a terminal to be in a first terminal configuration position, so terminal 90*c* is configured in such a manner to achieve this configuration. Lastly, the opening 71*d* of base portion 70 is positioned in a manner that requires a terminal to be in the third configuration position (see FIG. 3B). In addition, the configuration of receptacle 60 requires terminal 130 to also be a ground terminal. Thus, a ground contact portion 140 is used for terminal 130, and the ground terminal 130 is assembled in a manner to obtain the third terminal configuration position.

After inserting fasteners 110*a*, 110*b*, 110*c*, 110*d* into the respective clamp 100*a*, 100*b*, 100*c*, 100*d*, each of the terminals 90*a*, 90*b*, 90*c*, 130 may be inserted into base portion 70 so that the head of the fasteners 110*a*, 110*b*, 110*c*, 110*d* are positioned outward, towards, or into each of the openings 71*a*, 71*b*, 71*c*, 71*d* of base portion 70. The sequence of inserting the terminals 90*a*, 90*b*, 90*c*, 130 into base portion 70 is for illustrative purposes, and the terminals may be inserted into the base portion in any desired order.

The method of assembling the electrical receptacle may further include positioning an end (i.e. bared end) of a conductor in the channel of one or more of the clamps 100*a*, 100*b*, 100*c*, 100*d*, and tightening each of the respective fasteners 110*a*, 110*b*, 110*c*, 110*d* to hold the conductor against the tab of the contact portion 120*a*, 120*b*, 120*c*, 140 that is engaged with the respective notch of clamp 100*a*, 100*b*, 100*c*, 100*d*. As the fastener 110*a*, 110*b*, 110*c*, 110*d* is tightened, the fastener forces the bared end of the conductor against the tab of the contact portion that is engaged with the respective notch. Thus, the conductor is retained in the channel of the clamp. Further, the method of assembling the electrical receptacle 60 may further include engaging socket 85 with cover plate or cover portion 80, and engaging cover plate or cover portion 80 with base portion 70.

FIGS. 8A-8G are top views of standard blade configurations published by the National Electrical Manufacturers Association (NEMA), wherein each configuration includes a plurality of apertures. These NEMA blade configurations are examples of various plug/receptacle configurations where reconfigurable terminals can be used. It will be understood by those skilled in the art that these blade configurations are non-limiting, and a reconfigurable terminal can be used in any other suitable NEMA blade configurations or non-NEMA blade configurations.

Figure 8A:
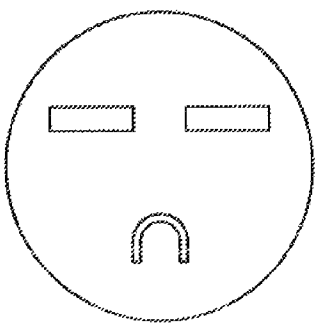
FIGS. 8A-8G include top views of exemplary NEMA blade configurations, wherein each configuration includes a plurality of apertures.
Figure 8B:
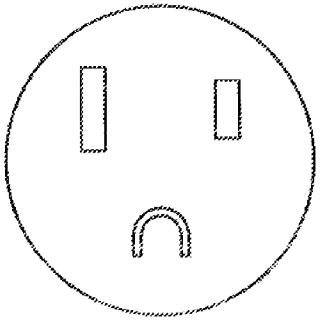

FIG. 8A is a NEMA 6-30 configuration, and FIG. 8B is a NEMA 6-50 configuration. In each of these embodiments, reconfigurable terminals can be used to engage each of the plug blades that extend through the apertures. The clamps used may, but not necessarily, be substantially identical to one another. In addition, the fasteners used may, but not necessarily, be substantially identical to one another. The power contact portions used may, but not necessarily, be substantially identical to one another. The ground contact portions may have the same geometry as the power contact portions, but the ground contact portions may have a wider spacing between the jaws to receive a ground pin. The clamps and contact portions in each terminal can be configured accordingly to align with the NEMA configurations shown and the openings in the base portion (not shown).

Figure 8C:
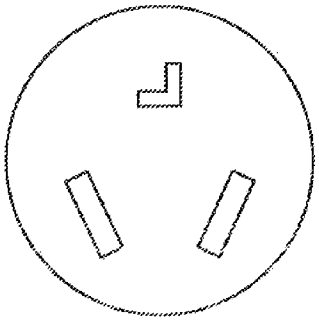
Figure 8D:
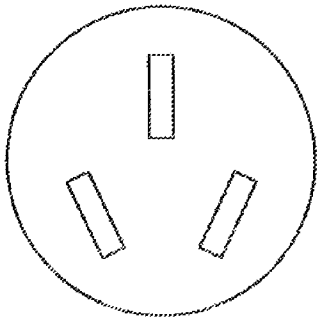
Figure 9A:
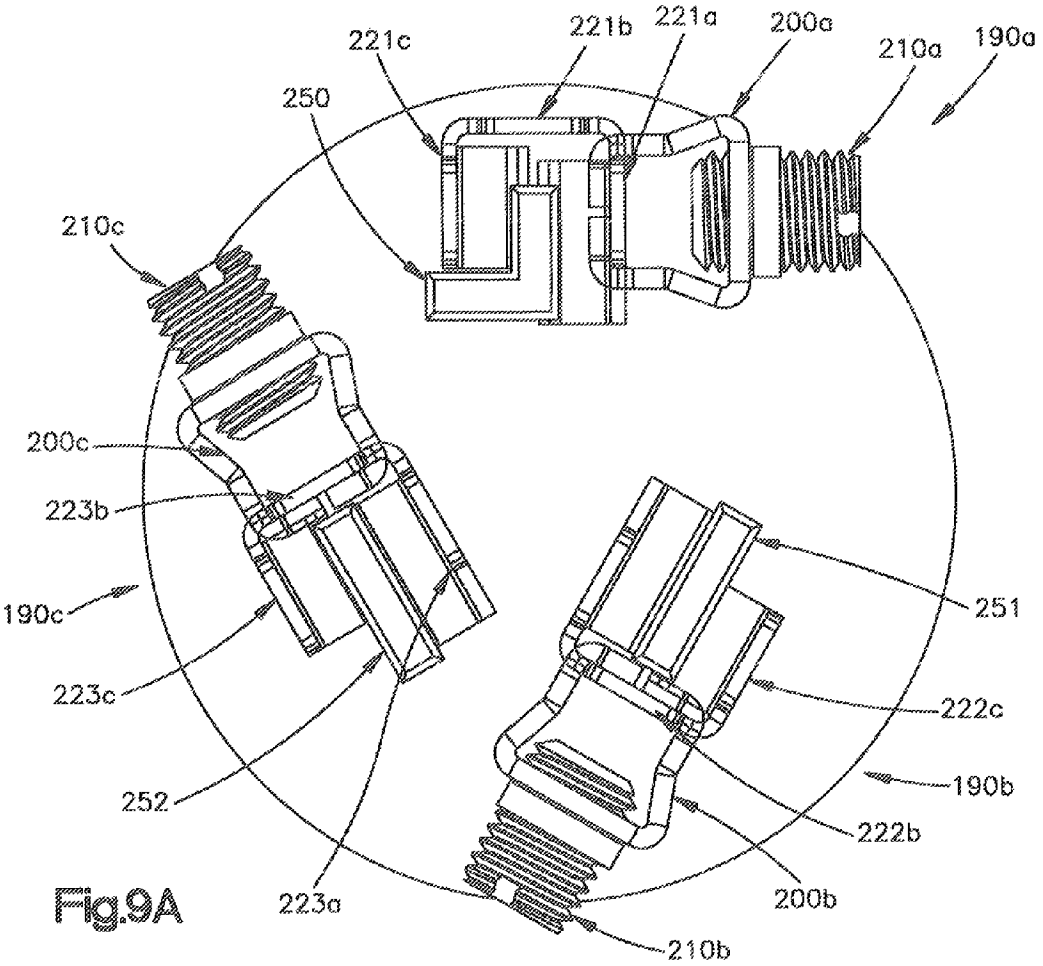
FIG. 9A is a bottom view of a plurality of plug blades that are in the same NEMA 10-30 blade configuration as FIG. 8C, wherein each plug blade is engaged with a terminal.
Figure 9B:
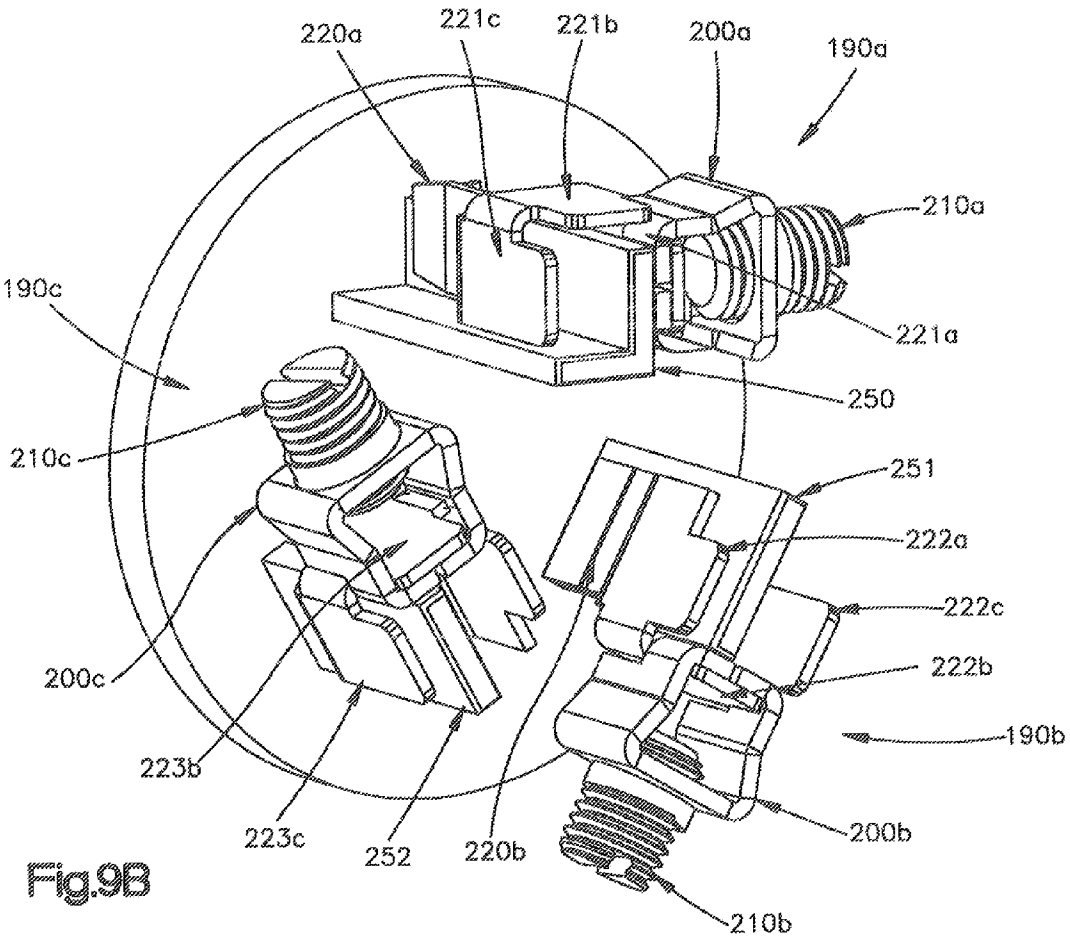
FIG. 9B is an isometric view of a plurality of plug blades that are in the same NEMA 10-30 blade configuration as FIG. 8C, wherein each plug blade is engaged with a terminal.

FIG. 8C is a NEMA 10-30 configuration; and, FIG. 8D is a NEMA 10-50 configuration. In both of these embodiments, the three respective terminals may, but not necessarily, include substantially identical contact portions, clamps, and fasteners. However, the three terminals may be configured differently according to a desired or predetermined orientation. FIGS. 9A-9B illustrate terminals that are configured to align with the configuration in the embodiment shown in FIG. 8C, and engage the plug blades.

Figure 8E:
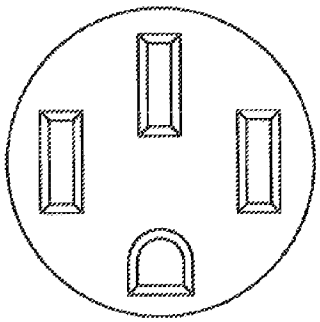
Figure 8F:
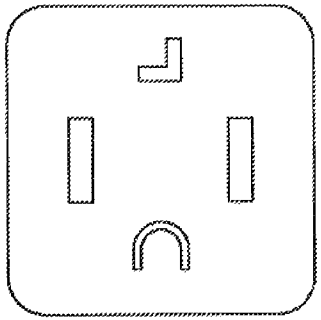
Figure 8G:
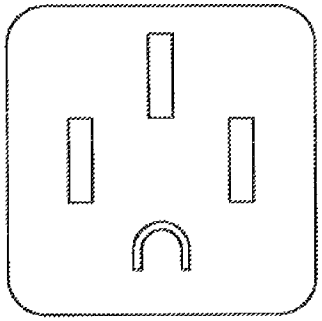

FIG. 8E and FIG. 8G are NEMA 14-50 configurations. FIG. 8F is a NEMA 14-30 configuration. In each of these embodiments, a reconfigurable terminal can be used to engage each of the four respective plug blades that extend through the apertures. The four terminal clamps (in each of the embodiments) may, but not necessarily, be substantially identical to one another. In addition, the four respective terminal fasteners (in each of the embodiments) may, but not necessarily, be substantially identical to one another. The plurality of power contact portions (in each of the embodiments) may, but not necessarily, be substantially identical to one another. The ground contact portion (in each of the embodiments) may, but not necessarily, have the same geometry as the power contact portions, but the ground contact portions may have a wider spacing between the jaws to receive a ground pin. The clamp and contact portion in each of the terminals in the embodiments can be configured accordingly to align with the NEMA configuration and the openings in the base portion (not shown).

With the exception of the ground terminals, the terminals used among the different NEMA configurations shown in FIGS. 8A-8G may, but not necessarily, include a clamp component that is substantially identical to the clamps used in the other embodiments, a fastener component that is substantially identical to the fasteners used in the other embodiments, and/or a contact portion component that is substantially identical to the contact positions used in the other embodiments. The ground terminals used among the different NEMA configurations shown in FIGS. 8A-8G may, but not necessarily, include a clamp component and/or a fastener component that is substantially identical to the clamps and/or fasteners used in the ground terminals and power contact terminals in the other embodiments. The ground contact portions used among the different embodiments of FIGS. 8A-8G may, but not necessarily, be substantially identical to the other ground contact portions used in the other embodiments. In addition, the ground portions may, but not necessarily, have the same geometry as the contact portions of the power terminals used in the same or different embodiments, but the ground contact portion may have a wider spacing between the jaws to receive a ground pin.

It should be understood that the embodiments in FIGS. 8A-8G are examples of various NEMA configurations wherein a reconfigurable terminal can be used to engage the plug blades that engage the apertures. Thus, a reconfigurable terminal can engage other plug blades of different NEMA configurations.

FIG. 9A is a bottom view and FIG. 9B is an isometric view of a NEMA 10-30 configuration (see FIG. 8C), including one L-shaped plug blade 250 and two straight plug blades 251, 252, wherein each plug blades extends through the socket aperture and engages with a respective terminal 190*a*, 190*b*, 190*c*. Terminal 190*a* includes a contact portion 220*a*, a clamp 200*a*, and a fastener 210*a*. Contact portion 220*a* includes a plurality of tabs 221*a*, 221*b*, 221*c*. Tab 221*a* of contact portion 220*a* engages a notch in clamp 200*a*. Thus, terminal 190*a* is in a second terminal configuration position (as shown in FIG. 3A). L-shaped plug blade 250 extends through the aperture and engages contact portion 220*a* of terminal 190*a*.

Terminal 190*b* includes contact portion 220*b*, clamp 200*b*, and fastener 210*b*. Contact portion 220*b* includes a plurality of tabs 222*a*, 222*b*, 222*c*. Tab 222*b* engages a notch on clamp 200*b*, and fastener 210*b* extends through an aperture on clamp 200*b*. Terminal 190*b* is in a first terminal configuration position (as shown in FIG. 2). Straight plug blade 251 extends through the socket aperture and engages contact portion 220*b* of terminal 190*b*. Terminal 190*c* is in a first terminal configuration position, and includes contact portion 220*c*, clamp 200*c*, and fastener 210*c*. Contact portion 220*c* includes a plurality of tabs 223*a*, 223*b*, 223*c*, with tab 223*b* engaging a notch in clamp 200*c*. Straight plug blade 252 extends through the socket aperture and engages contact portion 220*c* of terminal 190*c*.

In the exemplary embodiment in FIGS. 9A-9B, clamps 200*a*, 200*b*, 200*c* may, but not necessarily, be substantially identical. In addition, fasteners 210*a*, 210*b*, 210*c* may, but not necessarily, be substantially identical; and, contact portions 220*a*, 220*b*, 220*c* may, but not necessarily, be substantially identical. Each of terminals 190*a*, 190*b*, 190*c* are configured according to a desired or predetermined orientation.

While certain embodiments of the disclosure have been described herein, it is not intended that the disclosure be limited thereto, as it is intended that the disclosure be as broad in scope as the art will allow and that the specification be read likewise. Therefore, the above description should not be construed as limiting, but merely as exemplifications of particular embodiments. Those skilled in the art will envision additional modifications, features, and advantages within the scope and spirit of the claims appended hereto.

What is claimed is:

1. An electrical receptacle terminal for receiving an electrical plug blade, said terminal comprising;

a) a contact portion having a tabbed end including a plurality of tabs and a plug blade end configured to receive said electrical plug blade;

b) a clamp having a first notch and an aperture, wherein said first notch is arranged and configured to engage any one of said plurality of tabs; and c) a fastener having a surface that is adapted and configured for selectively and securingly engaging said aperture;

wherein said terminal is capable of being configured into a plurality of configurations depending on which one of said plurality of tabs said first notch engages.

2. The terminal of claim 1, wherein said contact portion is disposed at an angle to said clamp.

3. The terminal of claim 2, wherein said angle is substantially ninety degrees.

4. The terminal of claim 1, wherein said contact portion is one selected from the group consisting of a around contact portion and a power contact portion.

5. The terminal of claim 1, wherein said plurality of tabs comprises a first tab, a second tab and a third tab, wherein said terminal is in a first, second or third terminal configuration when said first, second or third tab is engaged with said first notch, respectively.

6. The terminal of claim 1, said clamp further comprising:

a) first and second walls disposed in opposing relation to one another; and b) third and fourth walls disposed in opposing relation to one another, each of said third and fourth walls further disposed between opposite distal ends of said first and second walls;

wherein said fourth wall includes said aperture and one of said first or second wall includes at least part of said first notch.

7. The terminal of claim 6, wherein at least one of said first and second wall is disposed at an angle to said third and fourth walls.

8. The terminal of claim 6, wherein each of said first and second walls are disposed at angles to said third and fourth walls.

9. The terminal of claim 6, wherein said first and second walls each include a portion of said first notch.

10. The terminal of claim 1, wherein said clamp further comprises a channel for receiving a conductor, wherein said channel is positioned between said first notch and said aperture.

11. The terminal of claim 10, wherein said fastener is configured to securely engage said conductor in said channel.

12. An electrical receptacle including a plurality of the terminals according to claim 1 for receiving an electrical plug having a corresponding plurality of plug blades, the electrical receptacle comprising:

a) a socket having a plurality of apertures, each of the plurality of socket apertures being arranged and configured to receive one of the corresponding plug blades;

b) a cover portion having an opening sized and configured to receive the socket; and c) a base portion configured to receive the cover portion, wherein the base portion is further configured to receive each of the plurality of terminals in a corresponding terminal configuration position, wherein each corresponding terminal configuration position aligns with one of the corresponding plurality of socket apertures, and wherein each of the plurality of terminals is further configured to be electrically connected to a corresponding electrical power conductor in an electrical junction box such that electrical power is provided to the electrical plug.

13. The electrical receptacle of claim 12, wherein each of the plurality of terminals includes a contact portion and a clamp, wherein each of the contact portions is disposed at an angle to the respective clamp.

14. The electrical receptacle of claim 13, wherein each of the angles is substantially ninety degrees.

15. The electrical receptacle of claim 12, wherein at least one of the plurality of terminals is a ground terminal, and wherein the contact portion of the ground terminal is a ground contact portion configured to receive a ground pin.

16. The electrical receptacle of claim 12, wherein the plurality of tabs of each of the contact portions of each of the of terminals comprise a first tab, a second tab and a third tab, wherein each of the plurality of terminals is in a first, second or third terminal configuration when the first, second or third tab is engaged with the first notch, respectively.

17. The electrical receptacle of claim 12, each of the clamps of each of the plurality of terminals further comprising:

a) first and second walls disposed in opposing relation to one another; and b) third and fourth walls disposed in opposing relation to one another, each of the third and fourth walls further disposed between opposite distal ends of the first and second walls;

wherein the fourth wall includes the aperture and one of the first or second wall includes at least part of the first notch.

18. The electrical receptacle of claim 17, wherein at least one of said first and second wall is disposed at an angle to said third and fourth walls.

19. The electrical receptacle of claim 17, wherein each of said first and second walls are disposed at angles to said third and fourth walls.

20. The electrical receptacle of claim 17, wherein said first and second walls each include a portion of said first notch.

21. The electrical receptacle of claim 12, wherein each of the clamps of each of the plurality of terminals further comprise a channel for receiving a conductor, wherein said channel is positioned between the first notch and the aperture.

22. The electrical receptacle of claim 21, wherein each of the plurality of terminals includes a fastener configured to securely engage the respective conductor in the respective channel.

23. A method of assembling the electrical receptacle terminal according to claim 1 for receiving an electrical plug blade, comprising the steps of:

a) engaging one of the plurality of tabs of the contact portion with the first notch of the clamp, wherein any one of the plurality of tabs engages with the first notch according to a predetermined orientation of the terminal; and b) inserting the fastener into the aperture of the clamp.

24. The method of claim 23, wherein said contact portion is disposed at an angle to said clamp.

25. A method of assembling an electrical receptacle for receiving an electrical plug having a plurality of plug blades with predetermined plug blade orientations, the electrical receptacle including a corresponding plurality of the terminals according to claim 1, the method comprising the steps of:

a) assembling each of the plurality of terminals into a terminal configuration corresponding to at least one of the plurality of plug blade orientations, wherein assembling each of the plurality of terminals comprises the steps of:

i. identifying one of the plurality of tabs of the contact portion that permits the terminal to be assembled in a terminal configuration corresponding to one of the plurality of plug blade orientations;

ii. engaging the identified tab of the contact portion with the first notch of the clamp; and iii. inserting a fastener into the aperture of the clamp; and b) providing a base portion configured to receive the plurality of assembled terminals;

c) inserting each of the plurality of assembled terminals into the base portion in a terminal orientation according to the respective plug blade orientation.

26. The method of claim 25, farther comprising the step of engaging a cover portion with the base portion.

27. The method of claim 25, wherein at least one of the contact portions of the plurality of terminals is a ground contact portion configured to receive a ground pin.

28. The method of claim 25, further comprising the steps of:

positioning a conductor in one of a plurality of channels, each of the plurality of channels positioned between the first notch and the aperture of the respective clamp of one of the plurality of terminals; and b) tightening the respective fastener of the one of the plurality of terminals to secure the conductor in the one of the plurality of channels.

29. The method of claim 25, wherein the base portion includes a plurality of openings, each of the plurality of openings to receive one of the plurality of assembled terminals.

* * * * *